United States Patent [19]

Lam et al.

[11] Patent Number: 4,553,955

[45] Date of Patent: Nov. 19, 1985

[54] MULTI-ANGLE ADAPTER FOR FIXED ANGLE CENTRIFUGE ROTOR

[75] Inventors: Kin C. Lam, Mountain View; Ronald K. Williams, Milpitas, both of Calif.

[73] Assignee: Beckman Instruments, Inc., Fullerton, Calif.

[21] Appl. No.: 616,331

[22] Filed: Jun. 1, 1984

[51] Int. Cl.[4] ..... B04B 5/02

[52] U.S. Cl. ..... 494/16

[58] Field of Search ..... 494/16, 19, 21, 20; 422/72

[56] References Cited

U.S. PATENT DOCUMENTS

| | | | |
|---|---|---|---|
| 4,221,325 | 9/1980 | Kubota | 494/16 |
| 4,301,963 | 11/1981 | Nielsen | 494/16 |
| 4,449,965 | 5/1984 | Strain | 494/16 |
| 4,460,351 | 7/1984 | Wakita | 494/16 |

*Primary Examiner*—Robert W. Jenkins

*Attorney, Agent, or Firm*—W. H. May; P. R. Harder; S. R. Markl

[57] ABSTRACT

A centrifuge rotor is provided with a plurality of cavities having a non-circular cross-section for receiving mating multi-angle adapters, which may be inserted in the cavities with selected rotational alignment about the cavity axes, to determine a plurality of select angle receiving chambers in the rotor for sample containers.

4 Claims, 4 Drawing Figures

MULTI-ANGLE ADAPTER FOR FIXED ANGLE CENTRIFUGE ROTOR

TECHNICAL FIELD

The present invention pertains to centrifuges having a rotor with fixed angle receiving chambers and in particular to a centrifuge rotor having a cooperating adapter by which receiving chambers may be formed with a selected angle.

BACKGROUND OF THE INVENTION

Centrifuges having rotors with fixed angle receiving chambers for a sample container (called a fixed angle rotor) are commonly known and manufactured by a number of sources. See generally *Centrifugation and Biology in Medical Science* by Phillip Scheeler, John Wiley & Sons Publishers, 1981. A fixed angle rotor comprises a rotor body having a generally disc-like shape with a rim portion, or other suitable structure around the circumference of the rotor into which a plurality of receiving chambers are formed. The receiving chambers formed have an angular relationship with the central axis of the rotor body about which the rotor body is rotated. Since the chambers are formed into the structure of the rotor body, the angular relationship which they possess relative to the rotational axis of the rotor is fixed. Each of the receiving chambers can receive a tube or other container containing a sample material which is to undergo centrifugation.

The angular relationship relative to the rotational axis selected for the receiving chambers formed in a rotor is generally between 25° and 45°. The specific angle which the chambers should have is determined by the sample content and the type of molecular separation which is desired to be performed by the centrifuge. Receiving chambers having a small angular relationship, i.e., near 25°, with the rotational axis of the rotor will have a greater average and more uniform centrifugal force field applied throughout the space defined by the chamber. This is due to the fact that the change in radial distance between the rotational axis of the rotor and the central axis of the chamber is less than that of greater angular chamber positions, according to the formula for the magnitude of centrifugal force at a point on a rotating element; thus, the more uniform the radius, the more constant the centrifugal force applied and the greater average radius over an elongate cavity, the greater the average centrifugal force applied thereto.

Conversely, receiving chambers having a greater angular relationship with the rotational axis of the rotor will have a more varied centrifugal force field applied along the length of the space defined by the chamber.

In operation, it is more desirable to have a smaller angular relationship of the chamber with the rotational axis of the rotor because in samples having sedimentable material, the sediment is separated from the sample solution more quickly due to the higher average centrifugal force field. However, the reduction of angular relationship of the chamber is limited by the ability of the sedimented material to flow or move along the side of the container in which the sample is contained once removed from solution. The angle at which material begins to accumulate along the side of the sample container during sedimentation in a centrifugal force field, and not flow toward the bottom of the sample container is defined as the angle of repose of that material. It is the angle of repose defined for a specific material which determines the desired angle at which a receiving chamber should be formed in the centrifuge rotor, to perform the desired separation and analysis.

Furthermore, it is often necessary for centrifuge analysis to be performed according to a documented protocol of past studies, which can require a specific angular definition of the receiving chamber in the fixed angle rotor of the centrifuge, for accurate comparative analysis.

In order to deal with a number of different sample solution compositions having various sample materials for separation, it has heretofore been necessary to provide numerous removable rotors for a centrifuge, each rotor having a select angular relationship of the receiving chambers for a sample container formed therein relative to the axis of rotation of the rotor for the cavities. Thus, a change in the composition of the sample to be centrifuged often requires a change in the fixed angle rotor used to obtain correct separation of sedimentable material.

DISCLOSURE OF THE INVENTION

The present invention comprises a centrifuge rotor having a plurality of noncircular-shaped cavities formed therein with a selected and fixed angular relationship relative to the axis of rotation of the rotor and a multi-angle chamber adapter having been constructed to mate with and enter a rotor cavity in one of a plurality of positions depending upon the rotational relationship of the adapter with a rotor cavity when the adapter is inserted therein.

The cavities formed in the rotor each have a selected angular relationship with the rotational axis of the rotor, the angle of each cavity being identical to the others. Each cavity is identically shaped to receive an adapter in a selected rotational relationship relative to the cavity axis, and maintain the relationship once the adapter is inserted therein.

The multi-angle adapter has a receiving chamber formed therein, the chamber having an angular relationship with the longitudinal axis of the adapter body which becomes coaxial with the axis of a rotor cavity upon entry of the adapter into a rotor cavity.

Due to the angular relationship of the receiving chamber formed in the adapter with the axis of the adapter body, the chamber can form a selected angle with the rotational axis of the rotor by selectively inserting the adapter into a rotor cavity with a relative rotational position therebetween in which the adapter receiving chamber obtains the desired angular relationship with the rotor's rotational axis when inserted. For instance, in a first rotational alignment of the adapter with a rotor cavity, the adapter receiving chamber can be selected to form a greatest angle with the rotational axis of the rotor and thus inserted into the rotor cavity to maintain the cavity-to-rotor-axis angular relationship. Likewise, the adapter may be withdrawn from the rotor cavity and turned approximately 180° into rotational alignment with the rotor cavity, so that the adapter receiving chamber forms a minimal angle with the rotational axis of the rotor, due to the adapter chamber's angular relationship within the adapter body, and thus aligned and reinserted into the rotor cavity to obtain a second angular relationship of the receiving chamber with the rotational axis of the rotor.

Thus, by selecting a desired rotational position of an adapter with a mating rotor cavity as it is inserted into the cavity, the angular relationship of the adapter receiving chamber can be selected relative to the rotational axis of the rotor. With this invention a select angle for the receiving chambers of the centrifuge rotor which receive sample containers for centrifugation may be changeably determined. The simple design and ease of manipulation of the multi-angle adapters which mate with the shaped and fixed angle rotor cavities permit selected angle of sample receiving chambers without need of changing the rotor. This substantially reduces the time and expense required to perform centrifugation of samples requiring differing fixed angle positions.

BEST MODE OF THE INVENTION

Figure 1:
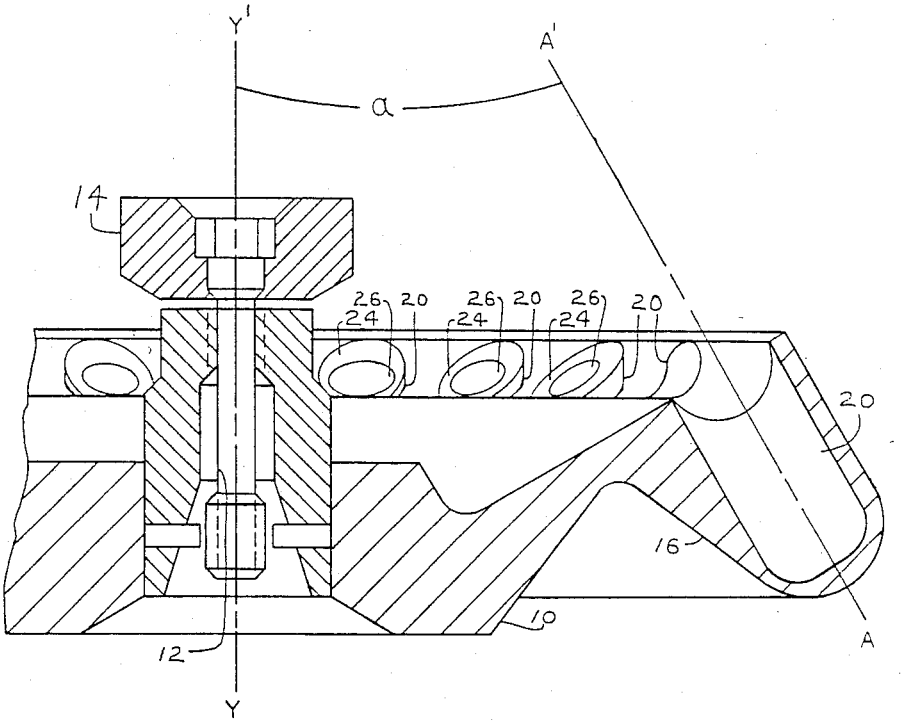
FIG. 1 is a sectional view depicting a vertical section through the center of a centrifuge rotor having shaped rotor cavities comprising a preferred embodiment of the present invention, with one rotor cavity bisected through its center.

The present invention comprises a centrifuge rotor having a plurality of shaped cavities of a noncircular cross-section formed symmetrically about the rotor center in an outer portion of the rotor, and a multi-angle adapter for insertion into the rotor cavities to selectively determine a fixed angle receiving chamber for receiving a sample container for centrifugation.

The rotor construction may be described with reference to FIG. 1. The rotor 10 has a generally disc-shaped body. A vertical bore 12 is centrally formed through the axial center of the rotor for receiving a shaft (not shown) upon which the rotor 10 may be mounted for rotation. The bore 12 defines a rotational axis Y—Y′ about which the rotor structure rotates. A rim portion 16 is formed around the circumference of the rotor to provide rotor structure in which a plurality of rotor cavities 20 are formed. The cavities are equally spaced around the perimeter of the rotor 10 and symmetrically equidistant relative to one another along their length from the axis Y—Y′. The cavities 20 formed in the rotor 10 have a selected angular relationship with the rotational axis Y—Y′ of the rotor, all being identical. Thus, the longitudinal axes A—A′ of each cavity 20 has a fixed angular relationship, with the opening of the cavity directed upwardly and inwardly, indicated as angle $\alpha$ with the rotational axis of the rotor Y—Y′. Each of the rotor cavities has the same angular relationship indicated by angle $\alpha$ relative to the rotational axis Y—Y′ of the rotor. Preferably, the rotor cavities 20 are formed such that angle $\alpha$ is equal to 35°.

Each of the rotor cavities 20 is identically shaped in depth and cross-sectional design. The cross-sectional design of the cavity is defined such that a cross-section is symmetrical about at least a longitudinal plane of the cavity, i.e., at least one plane intersecting the central longitudinal axis of the cavity. Preferably, the cross-sectional shape of a cavity 20 is generally eliptical with the major axis (widest dimension) vertically parallel with a radial line from the rotor center. However, the shape may comprise many other forms which would prohibit rotational movement of a mating-shaped element about longitudinal axis A—A′ when the element is inserted in the cavity 20.

Multi-angle adapters 24 designed for reception within the rotor cavities 20, are shown in FIG. 1 around the rearwardly positioned cavities, as identified. An adapter 24 is described with reference to FIG. 2. The adapter 24 comprises an elongate body 21 substantially equal in height to the depth of the rotor cavity 20. The adapter body has a cross-sectional shape identical, or similar, to the noncircular cross-sectional shape of a rotor cavity 20. The cross-sectional shape of a cavity 20 and the multi-angle adapter 24 is symmetrical about at least one central plane of these elements so that the adapter 24 may mate within a cavity 20 in more than one selected rotational position about its central longitudinal axis M—M′, upon insertion.

An adapter receiving chamber 26 is formed through the upper surface 28 of the adapter 24 and extends downwardly toward the bottom of the adapter ending in a closed bottom portion 29. The adapter chamber 26 is generally cylindrical in shape and adapted to receive sample containers such as test tubes or the like. The longitudinal axis of the adapter receiving chamber B—B′ forms an oblique angle $\beta$ with the longitudinal axis M—M′ of the adapter body 24. Since the longitudinal axis M—M′ of the adapter 24 coincides with the longitudinal axis A—A′ of a rotor cavity 20 when the adapter is inserted within the cavity, the longitudinal axis B—0 may form an oblique angle with the rotor cavity axis A—A′ when the adapter is inserted. By selectively positioning the adapter 24 in one of a plurality of rotational positions about the coincident axes A—A′, M—M′, in which the adapter 24 may be inserted into the cavity 20, as determined by the matable shapes therebetween, the longitudinal axis B—B′ of the adapter receiving chamber 26 may be positioned in a selected angular relationship $\theta$ to the rotational axis of the rotor Y—Y′.

Figure 3:
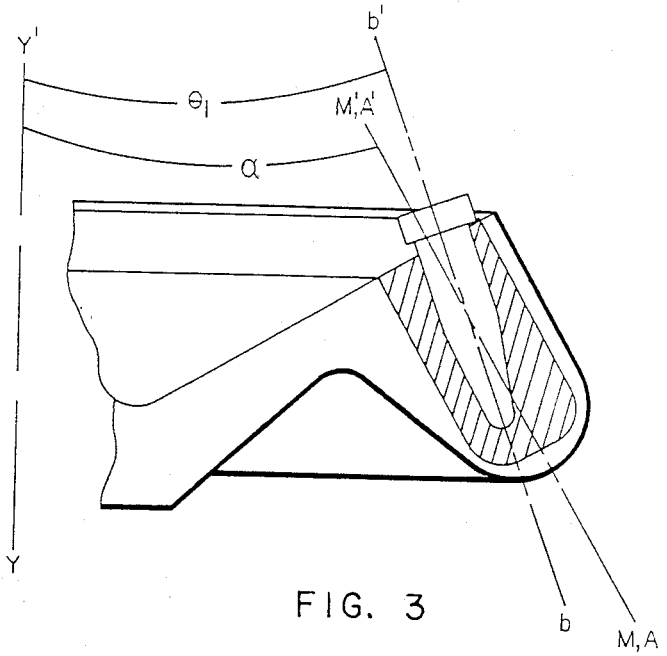
FIG. 3 is a cross-sectional view of one side of an embodiment of the presented centrifuge rotor, showing the multi-angle adapter inserted within a rotor cavity with a selected rotational alignment of the adapter which defines a minimal angular relationship between the adapter receiving chamber and the rotational axis of the rotor.
Figure 4:
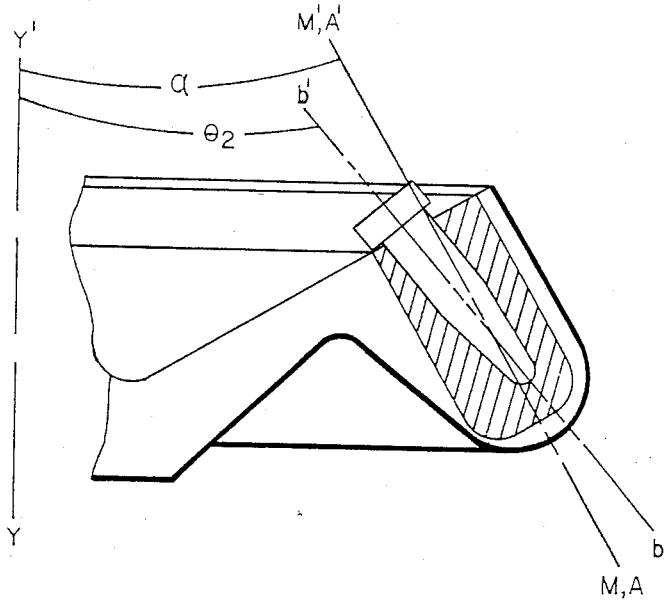
FIG. 4 is a cross-sectional view of one side of an embodiment of the presented centrifuge rotor showing a multi-angle adapter inserted within a rotor cavity with a selected rotational relationship differing 180° from that shown in FIG. 3, which defines a maximal angular relationship between the adapter receiving chamber and the rotational axis of the rotor.

For example, referring to FIG. 3, the adapter 24 may be rotationally aligned with the rotor cavity 20 for insertion such that when the adapter 24 is inserted in the cavity 20 the oblique angularity of the adapter receiving chamber 26, as shown by axis B—B′, relative to the coincident axes of the adapter-rotor cavity A—A′, M—M′, places the adapter chamber axis B—B′ in a more vertical position than the axes A—A′, M—M′. Thus, when the adapter 24 is inserted in a cavity 20 in this position, the adapter receiving chamber 26 forms an angle $\theta_1$ with the rotational axis Y—Y′ of the rotor which is smaller than the fixed angle $\alpha$ between the rotor cavity axis A—A′ and the rotational axis Y—Y′. Referring to FIG. 4, the adapter may be rotationally aligned with the rotor cavity 20 for insertion such that when the adapter 24 is inserted in the cavity 20 the oblique angularity of the adapter receiving chamber 26, as shown by axis B—B′, relative to the coincident axes of the adapter-rotor cavity A—A′, M—M′, places the adapter chamber axis B—B′ in a more horizontal position than the adapter-rotor cavity axes A—A′, M—M′. When the adapter 24 is inserted in a rotor cavity 20 in this position, the adapter receiving chamber 26 forms an angle $\theta_2$ with the rotational axis Y—Y′ of the rotor which is greater than the fixed angle a between the rotor cavity axis A—A′ and the rotational axis Y—Y′ of the rotor.

Thus, by selectively positioning the adapter 24 in a rotational position relative to the cavity 20 for insertion, a desired angular relationship of a receiving chamber 26 may be determined. Though a mating cross-sectional shape defineable as an eclipse is shown which permits two rotational positions for insertion of the adapter 24, 180° apart, other shapes may be used which permit more than two rotational positions and thus more than two selectable angles $\theta$ of the receiving chamber relative to rotational axis Y—Y′.

Figure 2:
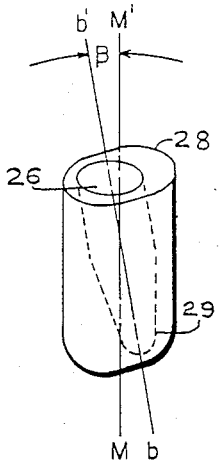
FIG. 2 is a perspective view of the preferred embodiment of a multi-angle adapter, having an obliquely formed cavity depicted by the hidden or broken line shown through its body.

Preferably, the oblique angle b formed between the longitudinal axis M—M′ of the multi-angle adapter 24 and the longitudinal axis B—B′ of the adapter receiving chamber 26, is equal to 10°, as shown in FIG. 2. With the angle $\beta$ equal to 10°, when the multi-angle adapter 24 is inserted into the rotor cavity 20 with the adapter receiving chamber 26 maximally vertical, as shown for the example in FIG. 3, the angle R will be smallest and equal to 25°. When the adapter 24 is inserted into the rotor cavity 20 with the adapter receiving chamber 26 maximally horizontal, as shown for the example in FIG. 4, angle $\theta$ will be largest and equal to 45°. Thus in the preferred embodiment, by selectively positioning the rotational alignment of the adapter 24 prior to insertion into the rotor cavity 20, the angular relationship of the adapter receiving chamber 26 relative to the rotational axis of the rotor A—A′ can be selectively determined between 25° and 45° depending upon the centrifugation to be performed. The rotor and adapter design presented herein is clearly advantageous over prior art fixed angle centrifuges by substantially increasing versatility and ease of use of a centrifuge used for consecutive separations requiring differing chamber angles, in addition to reducing cost through elimination of the need for multiple rotors.

We claim:

1. A rotor (10) for a centrifuge having a plurality of cavities (20) formed therein symmetrically positioned about the rotational axis of said rotor, and having a fixed angular relationship with the rotational axis of said rotor, said cavities comprising a non-circular cross-section having symmetry about at least one longitudinal plane; and an adapter (24) having a body with a cross-section similar to the cross-section of said rotor cavities such that said adapter may be matably inserted into a cavity in a plurality of rotational positions about a longitudinal axis of said cavity, said adapter having formed therein a receiving chamber (26) through an end surface of said adapter, said receiving chamber having an oblique angular relationship with a longitudinal axis of said adapter whereby an adapter can be matably inserted into a cavity of said rotor with a selected rotational alignment about said cavity axis to determine a select angular relationship of said receiving chamber with the rotational axis of said rotor.

2. The rotor of said adapter of claim 1, wherein said cavities formed in said rotor with the opening of said cavity directed upwardly and inwardly, a longitudinal axis of said cavity having a 35° angular relationship with the rotational axis of said rotor.

3. The rotor and adapter of claim 1 wherein said receiving chamber formed in the body of said adapter has a 10° angular relationship with a longitudinal axis of said adapter body.

4. The rotor and adapter of claim 1 wherein the cross-sectional shapes of said rotor cavity and said adapter body are mating elliptical cross-sections, with the major axis of said cavity cross-section vertically aligned with a radial line from the center of said rotor, such that rotation of said adapter is prohibited when said adapter is inserted in said rotor cavity.

* * * * *